US008942976B2

(12) United States Patent
Li et al.

(10) Patent No.: US 8,942,976 B2
(45) Date of Patent: Jan. 27, 2015

(54) METHOD AND DEVICE FOR NOISE REDUCTION CONTROL USING MICROPHONE ARRAY

(75) Inventors: Bo Li, Weifang (CN); Shasha Lou, Weifang (CN); Song Li, Weifang (CN)

(73) Assignee: Goertek Inc., Weifang (CN)

( * ) Notice: Subject to any disclaimer, the term of this patent is extended or adjusted under 35 U.S.C. 154(b) by 389 days.

(21) Appl. No.: 13/499,948

(22) PCT Filed: Dec. 15, 2010

(86) PCT No.: PCT/CN2010/079814

§ 371 (c)(1),
(2), (4) Date: Apr. 3, 2012

(87) PCT Pub. No.: WO2011/079716

PCT Pub. Date: Jul. 7, 2011

(65) Prior Publication Data

US 2012/0197638 A1 Aug. 2, 2012

(30) Foreign Application Priority Data

Dec. 28, 2009 (CN) ..... 2009 1 0265426

(51) Int. Cl.
*G10L 21/00* (2013.01)
*G10L 21/0208* (2013.01)
*G10L 21/0216* (2013.01)

(52) U.S. Cl.
CPC ... *G10L 21/0208* (2013.01); *G10L 2021/02166* (2013.01)
USPC ..... 704/226; 381/71.11; 381/71.1; 381/92; 381/94.7; 704/227; 704/233; 725/37; 372/19

(58) Field of Classification Search
CPC ..... G10L 15/00; G10L 15/20; H04R 1/40; H04R 29/00; H04R 3/00
USPC ..... 704/226, 227, 233; 725/37; 381/71.11, 381/73.1, 92, 24.7; 372/19
See application file for complete search history.

(56) References Cited

U.S. PATENT DOCUMENTS 5,539,859 A * 7/1996 Robbe et al. ..... 704/233
5,590,241 A * 12/1996 Park et al. ..... 704/227
5,864,804 A * 1/1999 Kalveram ..... 704/233
6,668,062 B1 * 12/2003 Luo et al. ..... 381/122

(Continued)

FOREIGN PATENT DOCUMENTS

CN 101587712 11/2005
CN 101587712 A 11/2005

(Continued)

OTHER PUBLICATIONS

Japanese Office Action dated Dec. 16, 2013.

(Continued)

*Primary Examiner* — Michael Colucci
(74) *Attorney, Agent, or Firm* — Troutman Sanders LLP

(57) ABSTRACT

The present invention provides a noise reduction control method using a microphone array and a noise reduction control device using a microphone array wherein the method comprises the steps of: S1: collecting, by the microphone array, acoustic signals; S2: estimating incidence angles of all acoustic signals of the microphone array; S3: conducting a statistics on signal components according to incidence angles; S4: determining a parameter α from a ratio of noise components according to the statistical result and using the parameter α as a control parameter for controlling an adaptive filter. With the present invention, space position information of the sound is obtained directly with the microphone array to control update of the adaptive filter more accurately, so as to eliminate noise, enhance SNR and protect speech quality well at the same time.

12 Claims, 4 Drawing Sheets

(56) References Cited

U.S. PATENT DOCUMENTS

| | | | | |
|---|---|---|---|---|
| 7,146,013 | B1 * | 12/2006 | Saito et al. | 381/92 |
| 7,567,678 | B2 * | 7/2009 | Kong et al. | 381/92 |
| 8,204,253 | B1 * | 6/2012 | Solbach | 381/94.7 |
| 2004/0165735 | A1 * | 8/2004 | Opitz | 381/92 |
| 2005/0047611 | A1 * | 3/2005 | Mao | 381/94.7 |
| 2006/0277571 | A1 * | 12/2006 | Marks et al. | 725/37 |
| 2008/0232408 | A1 * | 9/2008 | O'Brien et al. | 372/19 |
| 2008/0260175 | A1 * | 10/2008 | Elko | 381/73.1 |
| 2011/0019835 | A1 * | 1/2011 | Schmidt et al. | 381/71.11 |

FOREIGN PATENT DOCUMENTS

| | | | |
|---|---|---|---|
| CN | 101477800 | | 7/2009 |
| CN | 101477800 | A | 7/2009 |
| CN | 101510426 | | 8/2009 |
| CN | 101510426 | A | 8/2009 |
| WO | WO 0030404 | | 5/2000 |
| WO | WO 0030404 | A | 5/2000 |

OTHER PUBLICATIONS

Japanese Office Action dated Aug. 28, 2013.

Chinese Office Action for Chinese Priority Application No. 2009102654269 dated Feb. 7, 2014.

Chinese Office Action for Chinese Priority Application No. 2009102654269 dated May 14, 2013.

International Search Report for PCT/CN2010079814 Feb. 29, 2000.

* cited by examiner

METHOD AND DEVICE FOR NOISE REDUCTION CONTROL USING MICROPHONE ARRAY

BENEFIT CLAIMS

This application is a US National Stage of International Application No. PCT/CN2010/079814, filed Dec. 15, 2010, which claims the benefit of CN200910265426.9, filed Dec. 28, 2009.

FIELD OF INVENTION

The present invention relates to the field of adaptive noise reduction control with a microphone array, particularly to a method and a device for noise reduction control using a microphone array.

BACKGROUND

Wireless mobile communication technologies and devices have been applied widely in daily life and work, releasing space-time constraints in communications and offering great convenience for people. However, since there is no space-time confinement, communication environment may be complex and variable, which includes a noisy environment in which noises may severely degrade quality of speech communication, therefore speech enhancement technologies for suppressing noises play a significant role in modern communication.

In common speech enhancement technologies, there is a single microphone spectral subtraction speech enhancement technology also called single channel spectral subtraction speech enhancement technology, such as those disclosed in the patent document 1 (CN1684143A) and patent document 2 (CN101477800A). This technology has the following defects: Firstly, only steady-state noise can be suppressed, and there is no significant suppression for non-steady noise such as surrounding talking in supermarkets. Secondly, in a case of low SNR (signal to noise ratio), noise energy can not be evaluated accurately, hence damaging speech. Finally, this technology spends long time evaluating noise energy, therefore noise reduction works only after a period of noise occurrence.

The patent document 3 provides a better speech enhancement technology using a microphone array consisting of two or more microphones in which noises received by one microphone are used by an adaptive filter to counteract noise component in signals received by the other microphone and maintain speech component. Since in practice, signals received by both microphones contain speech components, speech may be damaged while reducing noises, therefore a critical difficulty of this technology is how to control convergence and filtering of the adaptive filter to protect speech in one microphone from being counteracted by speech in another while effectively suppressing noise.

In patent document 4, the microphone array has a directivity by designing specific locations of microphones, while in patent document 3, a directive microphone is used, which has different energy responses to signals from different directions, and determines signal directions by comparing energy differences to control noise elimination. However, this method imposes strict requirements for microphones, such as consistency of microphones or a directive microphone needs to be designed carefully to have significant directivity, hence having great limitations; secondly, using this method, in a case of an environment with high noises, speech state can not be accurately determined, thus the noise reduction process of adaptive filter can not controlled accurately, hence speech may be damaged while reducing noise.

Patent document 1: China patent of invention publication CN1684143

Patent document 2: China patent of invention publication CN101477800

Patent document 3: China patent of invention publication CN101466055

Patent document 4: China patent of invention publication CN101466056

SUMMARY

In view of the above problems in prior art, one object of the present invention is to determine accurately speech state with a microphone array consisting of two or more microphones, thereby effectively controlling an adaptive filter to eliminate noises, enhancing SNR and meanwhile protecting speech quality.

In order to solve the above-mentioned technical problem, the present invention provides an adaptive noise reduction control method using a microphone array comprising steps of:

S1: collecting, by the microphone array, acoustic signals;

S2: determining incidence angles of all acoustic signals of the microphone array;

S3: conducting statistics on signal components according to incidence angles;

S4: determining a parameter $\alpha$ from a ratio of noise component according to the statistical result and using the parameter $\alpha$ as a control parameter for controlling the adaptive filter.

Further, said step of determining incidence angles of acoustic signals comprises:

S201: conducting frequency domain transformation or sub-band transformation on the acoustic signals;

S202: calculating phase differences of various frequency bins or sub-bands of the microphone array signals and calculating relative time delays of the frequency bins or sub-bands of the microphone array signals from the phase differences;

S203: calculating incidence angles of the microphone array signals according to the relative time delays of the frequency bins or sub-bands.

In step S4, the adaptive filter is updated fast when there is only noises; and the adaptive filter is updated slow when there is target signals.

Preferably, the smaller $\alpha$ is, the slower the adaptive filter is updated; when $\alpha$ is 0, the acoustic signal is exactly a target speech signal, and the adaptive filter is not updated; in contrast, when $\alpha$ is 1, the acoustic signal is all of noise signals and the adaptive filter is updated at a fastest speed.

Preferably, after step S2, it further comprises: setting an angle transition range, dividing an entire space into several areas according to an amount of the target speech signals, calculating a parameter $\beta$ according to an area at which said incidence angle is located and taking $\beta*\alpha$ as the control parameter of the adaptive filter.

Further, an entire space is divided into a protection area, a transition area and a suppression area, wherein, $\beta=0$ for incidence angles within the protection area; $0<\beta<1$ for incidence angles within the transition area, and $\beta=1$ for incidence angles within the suppression area.

Said step of converting acoustic signals into frequency domain further comprises:

S2011: separating acoustic signals into individual frames;

S2012: each frame of signal, after the above framing, is windowed;

S2013: DFT converting windowed data into frequency domain.

Further, in step S2011, a acoustic signal $s_i$ is subjected to framing (i=1,2), with N sampling points in each frame or a frame size of 10 ms~32 ms, letting a $m^{th}$ frame of signal is $d_i(m,n)$, wherein $0 \le n < N$, $0 \le m$; there are M overlapping sampling points between two adjacent frames, with L=N-M sampling points of new data for each frame; the $m^{th}$ frame of data is $d_i(m, n)=s_i(m*L+n)$.

On the other hand, the present invention also provides a noise reduction control device using a microphone array comprising: a microphone array for collecting acoustic signals; a filtering control unit for determining incidence angles of all acoustic signals of the microphone array, implementing a statistics on signal components according to the incidence angles and then determining a parameter $\alpha$ from a ratio of noise component according to the statistical result and using the parameter $\alpha$ as a control parameter for controlling the adaptive filter; an adaptive filter for filtering noises.

Said filtering control unit comprises: a DFT unit for discrete Fourier transforming acoustic signals into frequency domain; a signal delay estimation unit for calculating phase differences between various frequency bins or sub-bands of the microphone array signals and calculating relative time delays of the frequency bins or sub-bands of the microphone array signals from the phase differences; a signal direction estimation unit for calculating incidence angles of the microphone array signals based on the relative time delays of the frequency bins or sub-bands; a signal component statistics unit for implementing statistics on components of the target signal according to said incidence angles and distinguishing the signals to find out a target signal component and a noise component, and estimating a parameter $\alpha$ from a ratio of noise components according to the statistical result and using the parameter $\alpha$ as a control parameter for controlling the adaptive filter.

Preferably, said signal component statistics unit is further configured for dividing an entire space into several areas, calculating a parameter $\beta$ based on an area in which said incidence angle is located and taking $\beta*\alpha$ as the control parameter of the adaptive filter.

Further, the DFT unit comprises: a framing unit for framing or separating the acoustic signals into individual frames; a windowing unit for windowing each frame of signal after framing; a DFT converting unit for DFT converting windowed data into frequency domain.

Further, preferably, the microphone array in the technical solution proposed in the present invention is completely comprised of omnidirectional microphones, or comprised of omnidirectional microphones and monodirectional microphones or completely comprised of monodirectional microphones.

By applying the above technology, space orientation information of the sound may be obtained directly with the microphone array to take full advantage of the orientation information to control update filtering of the adaptive filter more accurately, allowing protecting speech well while effectively reducing noises. In addition, this technology doesn't need energy information of signals, and it doesn't impose strict requirements on consistency of the two microphones, and would not be influenced by energy variation.

BRIEF DESCRIPTION OF DRAWINGS

The above-mentioned features and technical advantages of the present invention will become clearer and more apparent through the following description of other embodiments with reference to accompany drawings.

Figure 7:
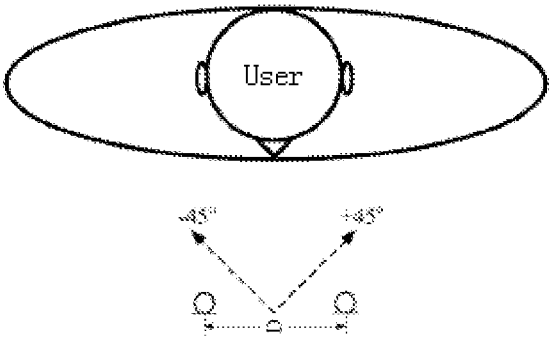
Figure 8:
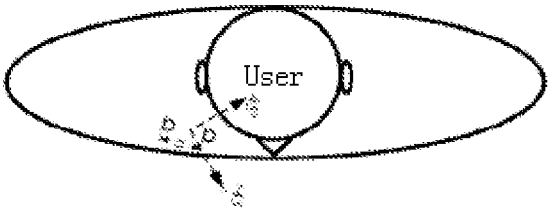

FIG. **6*a*** is graph showing a waveform of speech signals with noises before noise reduction according to an embodiment of the present invention;

FIG. **6*b*** is a graph showing a waveform of speech signals after noise reduction according to an embodiment of the present invention;

FIG. 7 is a diagram showing positions of two microphones of an array according to an embodiment of the present invention; and FIG. 8 is a diagram showing positions of two microphones of an array suitable for dual-microphone headset according to an embodiment of the present invention.

DETAIL DESCRIPTION

The present invention will be described in more detail below by way of specific embodiments with reference to drawings.

According to noise reduction technologies in the prior art for microphone array, taking a microphone array consisting of two microphones as an example, typically, noise reduction is implemented using an adaptive filter with respect to acoustic signals collected by two microphones, wherein acoustic signals collected by the two microphones are regarded as noisy speech signal $s_1$ and reference signal $s_2$, respectively. First of all, the reference signal $s_2$ is input into the adaptive filter for filtering to output an estimated noise signal $s_3$, subtracting $s_3$ from the noisy speech signal $s_1$ results in signal y, and y is fed back to the adaptive filter for updating a filter weight value. When y has large energy, the adaptive filter is updated quickly to make $s_3$ continuously approach $s_1$, then the energy of y resulted from subtraction between $s_1$ and $s_3$ becomes less and less. When $s_3=s_1$, y has the least energy, the adaptive filter stops updating, hence realizing the effect of suppressing noise of $s_1$ with $s_2$.

When $s_1$ and $s_2$ received by the microphone array contain only noise signals, the adaptive filter may suppress noises very well. However, when $s_1$ and $s_2$ contain speech signals, in order for y, which is resulted from subtracting s3 from s1, has the least energy, the adaptive filter may balance out speech signals therein, hence damaging speech. Therefore, in order not to suppress speech, the present invention provides a method for controlling update and filtering of the adaptive filter by means of sound incidence direction, which method can prevent the adaptive filter from damaging speech when speech occurs.

Figure 1:
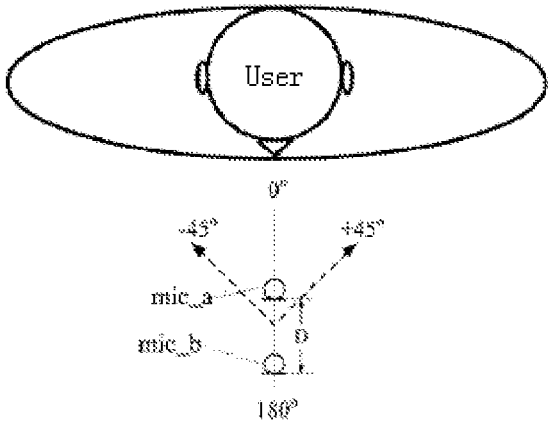
FIG. 1 is a diagram showing positions of the two microphone of a array according to an embodiment of the present invention.

FIG. 1 is a diagram showing the arrangement of a two-microphone array according to an embodiment of the present invention. As shown in FIG. 1, in this embodiment, the microphone array is consisted of two omnidirectional microphones mic_a and mic_b with spacing therebetween D=2 cm, and a user speaks in the range from −45 degree to 45 degree as shown in FIG. 1.

Figure 2:
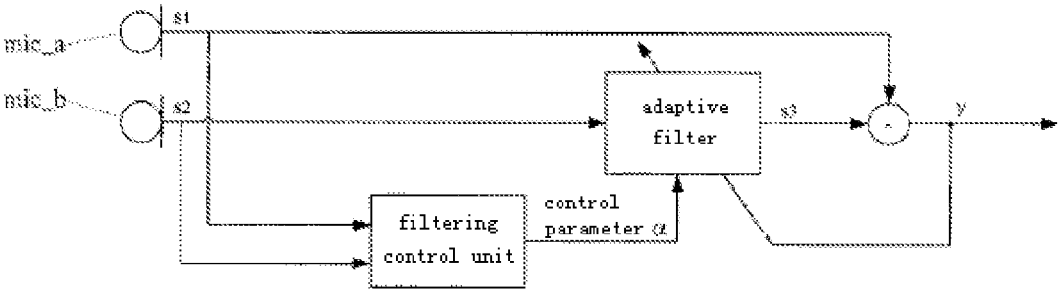
FIG. 2 is a diagram showing basic principle of a dual-microphone embodiment of the present invention.

FIG. 2 is a schematic diagram showing basic principle of the dual-microphone speech enhancement scheme according to an embodiment of the present invention. As shown in FIG. 2, the two omnidirectional microphones mic_a and mic_b collect acoustic signals $s_1$ and $s_2$ respectively. It is worthy noted that in the process of noise reduction in this embodiment, the acoustic signal $s_1$ is treated as a desired voice signal and the acoustic signal $s_2$ is treated as a reference signal. Firstly, acoustic signals $s_1$ and $s_2$ are processed by a filtering control unit to obtain a control parameter $\alpha$. Then, the adaptive filter H adjusts the update rate according to the control parameter $\alpha$ and calculates the estimated noise signal $s_3$. Subtracting the estimated noise signal s3 from the desired voice signal s1 results in noise reduced voice signal y, and then y is fed back to the adaptive filter for updating the filter weight to make noise in y has least energy while the energy of speech is not changed, achieving the effect of protecting speech while suppressing noises.

Figure 3:
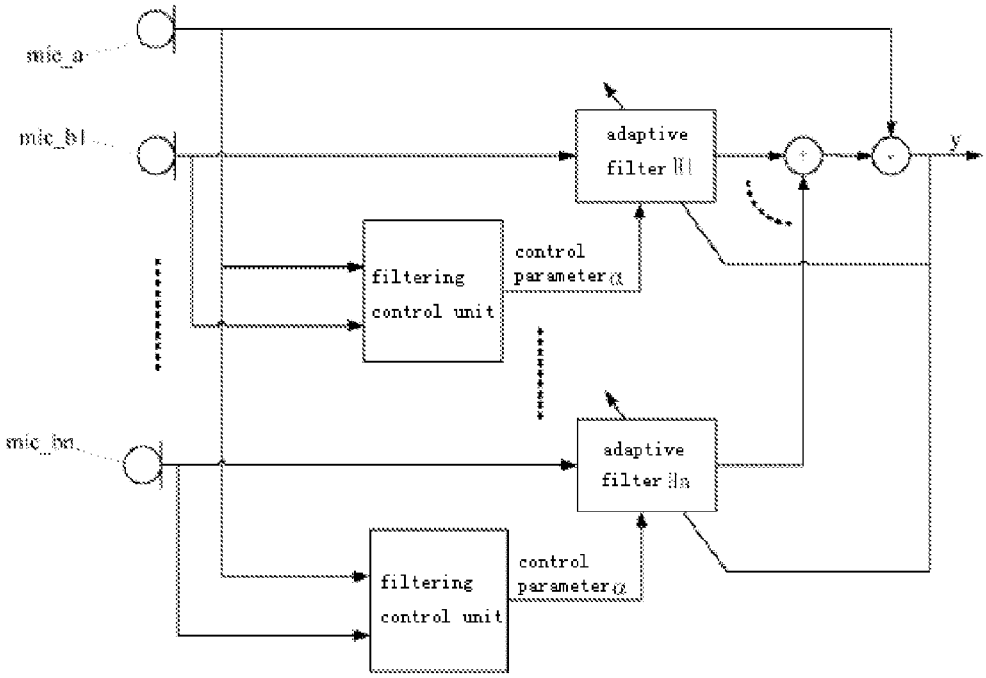
FIG. 3 is a diagram showing basic principle of a microphone array embodiment of the present invention.

FIG. 3 is a schematic diagram showing basic principle of an scheme of the microphone array consisted of a plurality of microphones according to an embodiment of the present invention. As shown in FIG. 3, n+1 omnidirectional microphones mic_a, mic_b1 . . . mic_bn constitute a microphone array, and in the process of noise reduction in this embodiment, the acoustic signal collected by the microphone mic_a is treated as the desired acoustic signal $s_1$, and the acoustic signals collected by mic_b1 . . . mic_bn are treated as reference signals.

The scheme of a microphone array illustrated in FIG. 3 is different from that shown in FIG. 2 as follows. There are n microphones (mic_b1 . . . mic_bn) in the microphone array providing reference signals. The adaptive filter control module processes acoustic signals collected by these n microphones and the acoustic signal collected by mic_a respectively to obtain n control parameters $\alpha_i$. n (H1 . . . Hn) adaptive filters Hi (i=1 . . . n) adjust the update rate according to the control parameters $\alpha_i$ and calculate n noise signals that are accumulated to get the final estimated noise signal $s_3$. Then the estimated noise signal $s_3$ is subtracted from the desired acoustic signal s1 to obtain noise reduced speech signal y. At the same time, y is fed back to the adaptive filter to update filter weight, to make noise in y has minimum energy while the energy of speech signal in y is not changed, hence realizing the effect of protecting speech signals while suppressing noises.

In the embodiments shown in the above FIGS. 2 and 3, the adaptive filter can be a time domain adaptive filter or a frequency domain adaptive filter. Detail description will be given below for embodiments of noise reduction according to the present invention with a time domain adaptive filter and a frequency domain adaptive filter as examples respectively.

Figure 4:
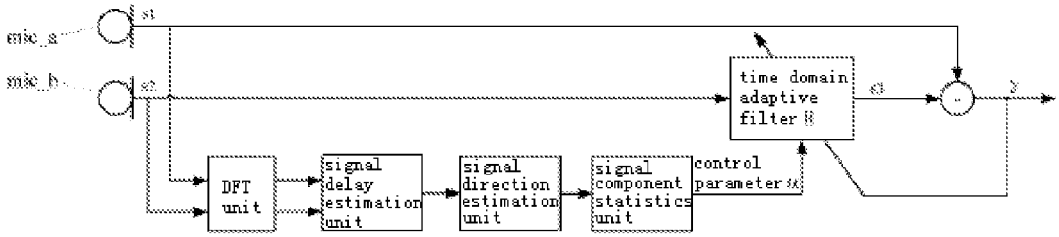
FIG. 4 is a schematic diagram showing the principle of noise reduction with dual microphones and a time domain adaptive filter according to an embodiment of the present invention.

FIG. 4 is a schematic diagram showing the principle of a scheme of noise reduction with dual microphones and an adaptive filter according to the present invention. As shown in FIG. 4, the microphone array is consisted of two omnidirectional microphones mic_a and mic_b. Firstly, the two microphones receive signals $s_1$ and $s_2$ at a sampling frequency $f_s$=8 kHz, wherein the signal $s_1$ is treated as desired speech signal and $s_2$ as reference signal. Then the signals are processed by the filtering control unit and control parameter $\alpha$ is output to the adaptive filter. The adaptive filter constrains its weights according to the control parameter $\alpha$ so as to conduct update and filtering at a corresponding speed and output estimated noise signal $s_3$. The noise in the desired speech signal $s_1$ is balanced out with the estimated noise signal $s_3$ to obtain the final noise reduced speech signal.

Among others, the filtering control unit includes a DFT unit, a signal delay estimation unit, a signal direction estimation unit and a signal composition evaluating unit, the DFT unit conducts discrete Fourier transform on the two signals to transform them into frequency domain respectively. Signals that have been transformed into frequency domain are input into the microphone signal delay estimation unit to calculate phase differences of each frequency bins or sub-bands of the two signals, and then relative time delays of each of frequency bins or sub-bands of the two signals are calculated according to phase differences. Assuming the target speech signal is incident from 0 degree direction, the signal direction estimation unit converts relative time delays of each of frequency bins or sub-bands of the two signals into their incidence angle, and target speech components within the angle of protection and noise components outside the angle of protection may be distinguished according to their incidence angles. The signal component statistics unit evaluates components of target speech signals whose incident angles locate within the angle of protection and calculates the control parameter $\alpha$ ($0 \le \alpha \le 1$).

The more noise components, whose incident angles are outside the angle of protection, the larger the control parameter $\alpha$ is, and the faster the updating of the adaptive filter is. When all received signals are noise components outside the angle of protection, $\alpha$=1, the adaptive filter conducts the fastest update in this noise section, hence suppressing noise signals.

In contrast, the more the target signal components, which are within the angle of protection, the smaller $\alpha$ is, the slower the updating of the adaptive filter is. When all signals are target speech components, $\alpha$=0, the adaptive filter stops updating of weights of the filter in this speech section, thereby protecting speech in the desired speech signal $s_1$ from being balanced out, thus effectively protecting target speech from being damaged.

In FIG. 4, the noise reduced speech signal y is fed back to the time domain adaptive filter H. When y has large energy, the adaptive filter is updated quickly to make $s_3$ get closer and closer to $s_1$, then the energy of y resulted from subtracting $s_3$ from $s_1$ becomes less and less. When $s_3=s_1$, y has the minimum energy, the adaptive filter stops updating, hence realizing the effect of suppressing $s_1$ with $s_2$.

In FIG. 4, specific processing of the filtering control unit is as follows:

DFT unit conducts discrete Fourier transformation on signals $s_1$ and $s_2$: Firstly, $s_i$ (i=1,2) is subjected to framing to separate them into individual frames with N sampling points per frame or a frame size of 10 ms~32 ms, and represent the $m^{th}$ frame signal as $d_i(m, n)$, wherein $0 \le n < N$, $0 \le m$. There is an overlap of M (M=128~192) sampling points between two adjacent frames, that is, the first M sampling points of the current frame are the last M sampling points of the previous frame and there are only L=N-M sampling points of new data in each frame. Therefore the $m^{th}$ frame of data is $d_i(m,n)=s_i(m*L+n)$. In this embodiment, the frame size N=256, i.e., 32 ms, with overlap M=128, i.e., an overlap of 50%. After framing, each frame of signals are windowed with a window function win(n) and the windowed data is $g_i(m, n)=win(n)*d_i(m, n)$. As the window function, Hamming window, Hanning window etc. may be selected and in this embodiment, the Hanning window is selected:

$$win(n) = 0.5\left(1 - \cos\left(\frac{2\pi n}{N-1}\right)\right),$$

The windowed data is DFT converted into frequency domain $$G_i(m,k)e^{-j\phi_i(m,k)} = \frac{2}{N} * \sum_{n=0}^{N-1} g_i(m,n)e^{-j2\pi nk/N}$$

Wherein $$0 \le k \le \frac{N}{2}$$

indicates a frequency bin, $G_i(m,k)$ is the amplitude, and $\phi_i(m,k)$ is the phase.

The signal delay estimation unit calculates relative time delay of two signals:

$$\Delta T(m,k) = \frac{\phi_1(m,k) - \phi_2(m,k)}{2\pi f_s}$$

The signal direction estimation unit obtains the range of incidence angles based on a comparison between relative time delay $\Delta T(m,k)$ of signals and the time delay $\Delta T(\pm 45°)$ of the angle of protection (±45°):

$$\Delta T(m,k)\begin{cases} \le \Delta T(\frac{\pi}{4}), \text{outside protection angle} \\ > \Delta T(\frac{\pi}{4}), \text{within protection angle} \end{cases}$$

The signal component statistics unit implements a statistics on signal components within the protection angle based on $\Delta T(m,k)$, and then evaluates the control parameter $\alpha$ for updating the adaptive filter, $\alpha$ is a number between 0~1 determined by the amount of frequency contents within the angle of protection. When the number of frequency components within the angle of protection is 0, $\alpha=1$; when the number of frequency components outside the angle of protection is 0, $\alpha=0$.

As for the time domain adaptive filter, in this embodiment, the time domain adaptive filter is a FIR filter (finite impulse response filter) with length P(P≥1). The weight of the filter is $\vec{w}=[w(0),w(1),\ldots,w(P-1)]$. In this embodiment, P=64. The input signal of the adaptive filter is $s_2(n)$, the signal output from the filter is $s_3(n)$:

$$s_3(n)=w(0)*s(n)+w(1)*s_2(n-1)+\ldots+w(P-1)*s_2(n-P+1)$$

The counteracted signal y(n) as a result of counteracting $s_1(n)$ with $s_3(n)$ is obtained by subtraction $s_3(n)$ from $s_1(n)$: $y(n)=s_1(n)-s_3(n)$, y(n) is fed back to the adaptive filter for updating the weight of the filter:

$$\vec{w}(n)=\vec{w}(n)+\mu*y(n)*\vec{x}(n),\ \vec{x}(n)=[x(n),x(n-1),\ldots,x(n-P+1)],$$

The update rate $\mu$ is controlled by the parameter $\alpha$. When $\alpha=1$, i.e., $s_1(n)$, $s_2(n)$ contain only noise components, the adaptive filter converges quickly, which makes $s_3(n)$ identical to $s_1(n)$, therefore the counteracted y(n) has minimum energy, thereby eliminating noises. When $\alpha=0$, i.e., $s_1(n)$, $s_2(n)$ contain only target speech components, the adaptive filter stops updating, which makes the output signal $s_3(n)$ of the adaptive filter not converge to $s_1(n)$, and $s_3(n)$ and $s_1(n)$ are different, so that speech components will not be balanced out after subtraction $s_3(n)$ from $s_1(n)$ and speech components are maintained in the output y(n). When $0<\alpha<1$, i.e., signals collected by the microphones contain both speech components and noise components, then the update rate of the adaptive filter is controlled by the amounts of speech and noise components so as to ensure maintaining speech components while eliminating noises.

Figure 6A:
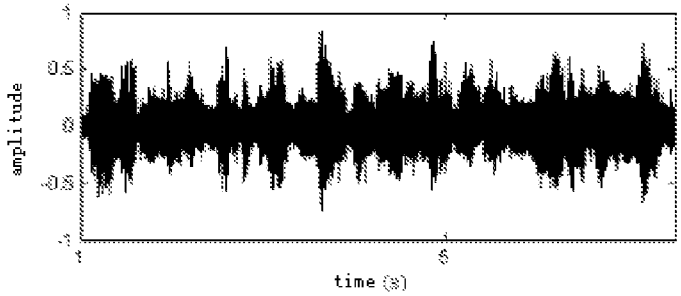
Figure 6B:
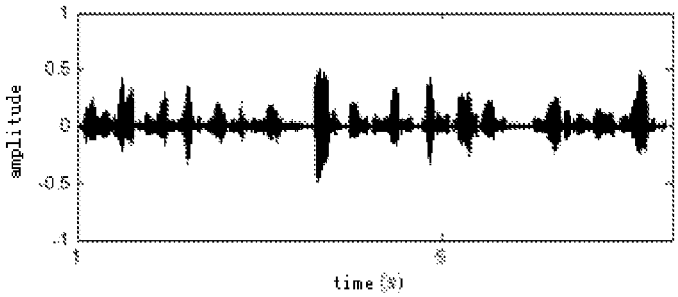

FIGS. 6*a* and 6*b* show wave patterns of speech signals with noises before the noise reduction processing of the present invention, and speech signals with noise reduced after the noise reduction processing of the embodiment of the invention, respectively. As shown in FIGS. 6*a* and 6*b*, the target speech comes in 0° direction and the music noise comes in 90° direction. FIG. 6*a* is the waveform of the original noisy speech signal $s_1$ collected by the microphone mic_a., FIG. 6*b* is the waveform of signal y after noise reduction of the present invention. It can be seen that the technical solution for noise reduction by means of voice incidence angles proposed in the present invention well protects the target speech while eliminating noises in the target speech, achieving a good noise reduction effect.

In addition, in the above-mentioned embodiment, the entire signal collection space is divided into two areas: a protection area and a suppression area, in a further case, a transition area may be additionally added, and a parameter $\beta(0\le\beta\le1)$ is obtained. $\beta=0$ for signal incidence angle within the protection area; $0<\beta<1$ within the transition area, the closer to the suppression area, the larger, and $\beta=1$ in the suppression area. $\beta*\alpha$ is the control parameter of the adaptive filter. This can make the control parameter of the adaptive filter more accurate, thereby enhancing noise reduction of speech.

According to an embodiment, the time domain adaptive filter is controlled by the control parameter $\alpha$ for noise reduction, however it is not limited to a time domain adaptive filter, it is also possible to control a frequency domain (sub-band) adaptive filter by the control parameter $\alpha$ for noise reduction. The difference between a time domain case and a frequency domain case is that: in a time domain case, the signal component statistics unit obtains a control parameter $\alpha$ by counting target signals or calculating a ratio of target signals to noise; in a frequency domain case, the signal component statistics unit obtains control parameters a of N frequency bins or sub-bands by evaluating incidence angles of each frequency bin or sub-band.

Figure 5:
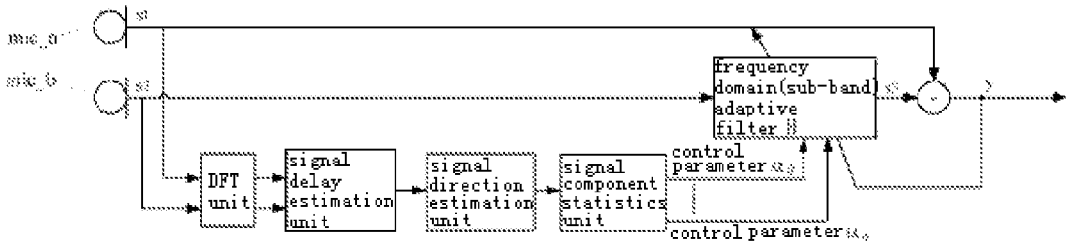
FIG. 5 is a schematic diagram showing the principle of noise reduction with dual microphones and a frequency domain (sub-band) adaptive filter according to an embodiment of the present invention.

FIG. 5 is a schematic diagram showing the principle of noise reduction with dual microphones and a frequency domain (sub-band) adaptive filter according to an embodiment of proposed in the present invention. As shown in FIG. 5, the DFT unit converts signals $s_1$ and $s_2$ collected by the two omnidirectional microphones mic_a and mic_b into frequency domain, and the signals converted into frequency domain are input to the microphone signal delay estimation unit to calculate relative time delays of each frequency bin or sub-band of the two signals. The signal direction estimation unit converts relative time delays of each frequency bin or sub-band signal into incidence angles of each frequency bins or sub-bands signal. The signal component statistics unit evaluates the position of each frequency bins or sub-bands' incidence angle within the angle of protection and calculates corresponding control parameter $\alpha_i$ (i=1 . . . n, representing frequency bin or sub-band).

The frequency domain (sub-band) adaptive filter conducts update control over each frequency bin or sub-band respectively after signal component statistics according to characteristics of frequency bins or sub-bands. The incidence angle of each frequency bin or sub-band is converted into the control parameter i; of the adaptive filter (i representing frequency bin or sub-band). The larger the incidence angle is, the more the speech of this frequency bin or sub-band deviates from the target speech that is in 0 degree direction, and thus the larger at is, and the more quickly this frequency bin or sub-band is updated. When the incidence angle of the $i^{th}$ frequency bin or sub-band is in the 0 degree direction within the angle of protection, $\alpha_i=0$, the sub-band adaptive filter does not update to protect the target speech component of this sub-band. When the incidence angle of the $i^{th}$ frequency bin or sub-band is outside of the angle of protection, and it deviates most from the target speech in the 0 degree direction, $\alpha_i=1$, the sub-band adaptive filter updates the most quickly to suppress the noise component in this sub-band.

By controlling frequency domain (sub-band) adaptive filters for noise reduction, the control parameter at for each frequency bin or sub-band may be obtained and update of each frequency bin or sub-band of frequency adaptive filter is controlled independently, resulting in more significant noise reduction effect.

Again, in this embodiment, a transition area may be additionally added to obtain a parameter $\beta(0\leq\beta\leq1)$, generating a new parameter $\alpha_i*\beta$. Wherein, $\beta=0$ for signal incidence angles within the protection area, $0<\beta<1$ within the transition area, the closer to the suppression area, the larger, and $\beta=1$ in the suppression area. $\alpha_i*\beta$ is used as the control parameter of the adaptive filter. This can also make the control parameter of the adaptive filter more accurate, thereby enhancing noise reduction for speech.

Still further, in a case where a transition area is added, to calculate the parameter $\beta_i(0\leq\beta_i\leq1)$ for each frequency bin or sub-band is calculated, wherein, $\beta_i=0$ for signal incidence angles within the protection area, $0<\beta_i<1$ within the transition area, the closer to the suppression area, the larger, and $\beta_i=1$ in the suppression area. A new control parameter $\alpha_i*\beta_i$ is generated and $\alpha_i*\beta_i$ is used as the control parameter signal of the adaptive filter. This further improves the accuracy of the control parameter of the adaptive filter, thereby further enhancing the effect of noise reduction for speech.

While the protection area set in the above-mentioned embodiment is −45°~45°, it may be adjusted in practice according to user's real position and demands. Positions of the two microphones relative to the user is not limited to those shown in FIG. 1, they may locate at any positions as long as there is no obstacle blocking propagation of acoustic signals between the microphones and the user's mouth or the target sound source, such as the positions of the two microphone arrays shown in FIG. 7 and the positions suitable for a two-microphone array of a dual-microphone earpiece shown in FIG. 8.

Furthermore, it is noted that since no energy information of signals is required during noise reduction process according to this application, there is no strict requirement on consistency of the two microphones; the energy variation of acoustic signals has no influence, and there is no strict requirement on directivity of microphones. Therefore, as compared with prior art microphone noise reduction technologies, the present invention is easier to realize. Although in the above-mentioned embodiment proposed in the present invention, microphone arrays all consisted of omnidirectional microphones are employed, microphone arrays consisted of omnidirectional microphones and monodirectional microphones or microphone arrays consisted of all monodirectional microphones may be used.

Under the above teachings of the present invention, those skilled in the art may make various modifications and changes on the basis of the above-mentioned embodiments, which all lie in the protection scope of the present invention. Those skilled in the art will understand that the above specific description is only for the purpose of better explaining the present invention and the scope of the present invention is defined by the claims and their equivalents.

The invention claimed is:

1. A noise reduction method using a microphone array, characterized by comprising steps of:

S1: collecting, by the microphone array, acoustic signals;

S2: estimating incidence angles of all acoustic signals collected by the microphone array, and;

distinguishing between target speech components and noise components based on the incidence angles, wherein the target speech components have incidence angles within an angle of protection, and wherein the noise components have incidence angles outside the angle or protection;

S3: conducting a statistics on signal components according to the incidence angles;

S4: determining a control parameter $\alpha$ from a ratio of noise components according to the statistical result and using the parameter $\alpha$ as a control parameter for updating an adaptive filter for reducing noise from the collected acoustic signals, wherein the more noise components, the larger the control parameter $\alpha$, and the faster the updating of the adaptive filter, wherein when all the collected acoustic signals are noise components, $\alpha$ is determined to be 1, and the adaptive filter conducts the fastest update to suppress noise, and wherein when all the collected acoustic signals are target speech components, $\alpha$ is determined to be 0, and the adaptive filter stops updating weights of the filter to protect the target speech components from being damaged.

2. A noise reduction method using a microphone array of claim 1, said step of determining incidence angles of sounds comprises:

S201: conducting frequency domain transformation or sub-band transformation on the acoustic signals;

S202: calculating phase differences of each frequency bins or sub-bands of the signals collected by the microphone array and calculating relative time delays of each of the frequency bins or sub-bands of signals of the microphone array based on the phase differences;

S203: calculating incidence angles of signals collected by the microphone array based on the relative time delays of each of the frequency bins or sub-bands.

3. A noise reduction method using a microphone array of claim 1 or 2, characterized in that in step S4, specifically, the adaptive filter is updated fast when there are only noises; and the adaptive filter is updated slow when there is any target signal.

4. A noise reduction method using a microphone array of claim 3, characterized in that after step S2, it further comprises:

dividing an entire space into a protection area, a transition area and a suppression area, calculating a parameter $\beta$ according to an area in which said incidence angle is located and taking $\beta*\alpha$ as the control parameter of the adaptive filter, wherein, $\beta=0$ for incidence angles with in the protection area; $0<\beta<1$ for incidence angle angles within the transition area and $\beta=1$ for incidence angles within the suppression area.

5. A noise reduction method using a microphone array of claim 2, characterized in that said step of converting acoustic signals into frequency domain further comprises:

S2011: subjecting acoustic signals to framing;

S2012: applying a window function to each frame of signal after framing;

S2013: transforming windowed data into frequency domain by using DFT.

6. A noise reduction method using a microphone array of claim 5, characterized in that in step S2011, the acoustic signal $s_i$ is subjected to framing (i=1,2), with N sample points in each frame or a frame size of 10 ms~32 ms, letting a $m^{th}$ frame of signal is $d_i(m, n)$, wherein $0\leq n<N$, $0\leq m$; there are M overlapping sample points between two adjacent frames, with L=N-M sample points of new data for each frame;

the $m^{th}$ frame of data is $d_i(m, n)=s_i(m*L+n)$, wherein, $s_i$ represents an acoustic signal, i indicates an index of a microphone, and di(m, n) represents the $m^{th}$ signals of the acoustic signals $s_i$ after being subjected to framing.

7. A noise reduction method using a microphone array of claim 6, characterized in that assuming N=256, and overlapping number M=128~192.

8. A noise reduction device using a microphone array, comprising:

a microphone array for collecting acoustic signals;

a filtering control unit for determining incidence angles of all acoustic signals collected by the microphone array, conducting a statistics on signal components based on the incidence angles and then determining a control from a ratio of noise components according to the statistical result and using the parameter $\alpha$ as a control parameter for updating an adaptive filter;

an adaptive filter for filtering out noises from the collected acoustic signals;

wherein the filtering control unit distinguishes between target speech components and noise components based on the incidence angles, wherein the target speech components have incidence angles within an angle of protection, wherein the noise components have incidence angles outside the angle or protection;

wherein the more noise components, the larger the control parameter $\alpha$, and the faster the updating of the adaptive filter, wherein when all the collected acoustic signals are noise components, $\alpha$ is determined to be 1, and the adaptive filter conducts the fastest update to suppress noise, and wherein when all the collected acoustic signals are target speech components, $\alpha$ is determined to be 0, and the adaptive filter stops updating weights of the filter to protect the target speech components from being damaged.

9. A noise reduction device using a microphone array of claim 8, characterized in that said filtering control unit comprises:

a DFT unit for discrete Fourier transforming acoustic signals into frequency domain;

a signal delay estimation unit for calculating phase differences of each frequency bins or sub-bands of the signals collected by the microphone array and calculating relative time delays of each frequency bins or sub-bands of the signals collected by the microphone array based on the phase differences;

a signal direction estimation unit for calculating incidence angles of the signals collected by the microphone array based on the relative time delays of each frequency bins or sub-bands;

a signal component statistics unit for conducting a statistics on components of target signal based on said incidence angles and distinguishing them to find out a target signal component and noise component, and determining the control parameter $\alpha$ from a ratio of noise components according to the statistical result and using the parameter $\alpha$ as a control parameter for controlling the adaptive filter.

10. A noise reduction device using a microphone array of claim 9, characterized in that said DFT unit comprises:

a framing unit for framing the acoustic signals;

a window function unit for applying a window function to each frame of signal after framing;

a DFT converting unit for transforming windowed data into frequency domain.

11. A noise reduction device using a microphone array of claim 9, characterized in that said signal component statistics unit is further configured for dividing an entire space into several areas, calculating a parameter $\beta$ according to an area in which said incidence angle is located, and taking $\beta*\alpha$ as the control parameter of the adaptive filter.

12. A noise reduction device using a microphone array of any one of claims 8-10, characterized in that said microphone array is completely comprised of omnidirectional microphones or comprised of omnidirectional microphones and monodirectional microphones or completely comprised of monodirectional microphones.

* * * * *